United States Patent [19]

Schildkraut et al.

[11] Patent Number: 4,588,246

[45] **Date of Patent: * May 13, 1986**

[54] ANTI-DECOUPLING MECHANISM FOR AN ELECTRICAL CONNECTOR ASSEMBLY

[75] Inventors: Alan L. Schildkraut, Sidney; Robert W. Brush, Sr., Unadilla, both of N.Y.

[73] Assignee: Allied Corporation, Morristown, N.J.

[ * ] Notice: The portion of the term of this patent subsequent to Jun. 25, 2002 has been disclaimed.

[21] Appl. No.: 698,285

[22] Filed: Feb. 4, 1985

Related U.S. Application Data

[62] Division of Ser. No. 493,535, May 11, 1983, Pat. No. 4,525,017.

[51] Int. Cl.[4] ..... H01R 13/623

[52] U.S. Cl. ..... 339/89 R; 339/DIG. 2

[58] Field of Search ..... 339/89 R, 89 L, 89 M, 339/90 R, 90 C, DIG. 2; 285/82, 89, 92; 267/156, 155, 157; 192/72, 81 C, 415, 12 BA, 17 D, 8 C

[56] References Cited

U.S. PATENT DOCUMENTS

| | | | |
|---|---|---|---|
| 718,366 | 1/1903 | Freund | 83/345 |
| 957,504 | 5/1910 | Frenot | 411/143 |
| 1,011,871 | 12/1911 | Smoke | 411/331 |
| 1,629,098 | 5/1927 | Drexler | 192/81 C |
| 3,019,871 | 2/1962 | Sauzedde | 192/415 |
| 3,021,512 | 2/1962 | Welsh et al. | 192/81 C |
| 3,517,371 | 6/1970 | Buckley | 339/89 |
| 3,594,700 | 7/1971 | Nava | 339/89 R |
| 3,646,495 | 2/1972 | Cowmeadow | 339/46 C |
| 3,663,926 | 5/1972 | Brandt | 339/89 R |
| 3,669,472 | 6/1972 | Nadsady | 339/89 R |
| 3,786,396 | 1/1974 | Kemmer | 339/89 R |
| 3,801,954 | 4/1974 | Dorrel | 339/90 R |
| 3,917,373 | 11/1975 | Peterson | 339/89 R |
| 3,971,614 | 7/1976 | Paoli et al. | 339/89 |
| 4,007,953 | 2/1977 | Powell | 339/89 R |
| 4,030,798 | 6/1977 | Paoli | 339/89 R |
| 4,056,298 | 11/1977 | Cooper | 339/89 M |
| 4,066,315 | 1/1978 | Arneson | 339/89 M |
| 4,165,910 | 8/1979 | Anderson | 339/89 M |
| 4,189,040 | 2/1980 | Braunschweig | 192/81 C |
| 4,359,255 | 11/1982 | Gallusser et al. | 339/90 R |

*Primary Examiner*—John McQuade
*Attorney, Agent, or Firm*—C. D. Lacina

[57] ABSTRACT

A spiral band (400) having a lock arm (420) for resisting rotation of a coupling nut (300) relative to a plug shell (100), coupling nut (300) including a radial flange (322) having a plurality of detents (340) disposed equiangularly therearound and spiral band (400) being tightly spiraled to interference fit an annular groove (110) of plug connector shell (100) and dome shaped to axially bias the plug shell (100) oppositely of the coupling nut (300), radial expansion of the spring band (400) relative to the plug shell by lock arm (420) allowing uncoupling rotation and radial contraction of spring band (400) followed by lateral deflection of the lock arm from engagement with the detent (340) allowing uncoupling rotation.

2 Claims, 6 Drawing Figures

FIG. 1
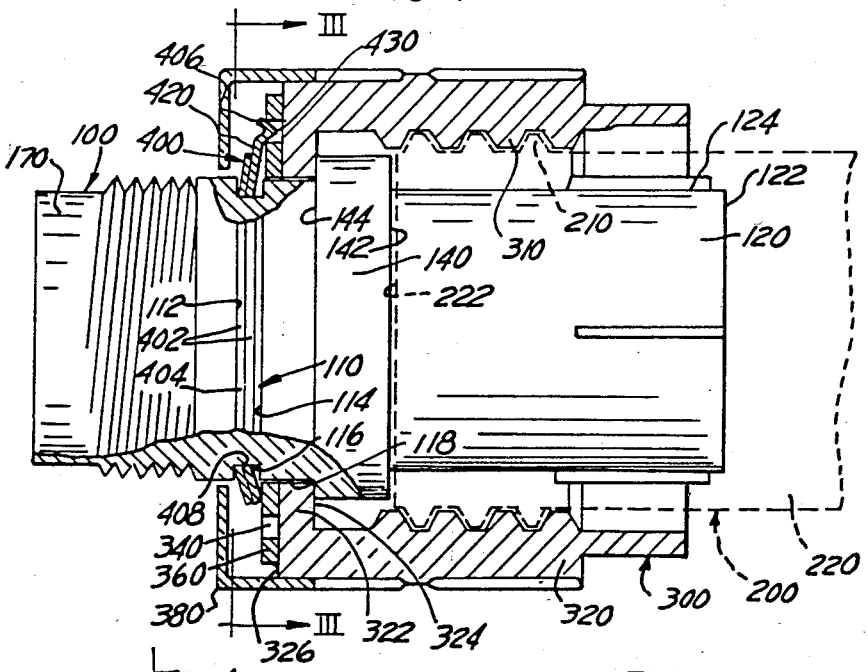
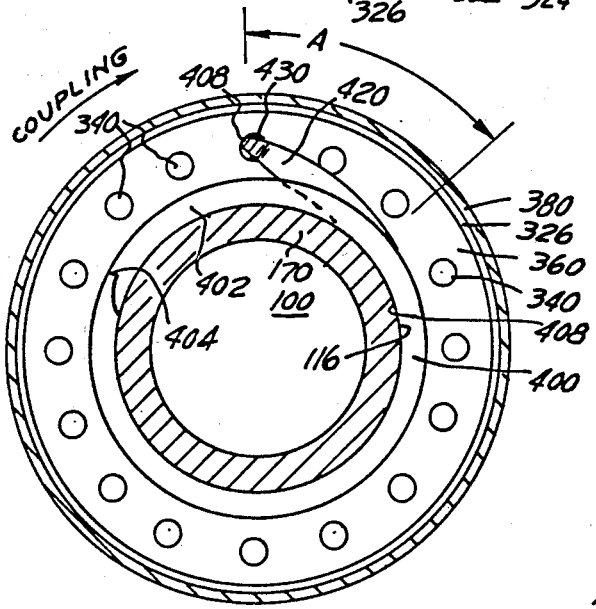
FIG. 3
FIG. 4
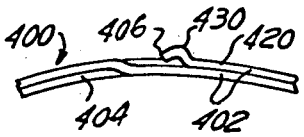
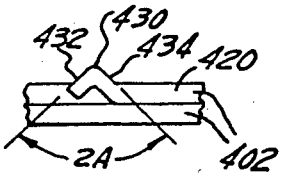
FIG. 5
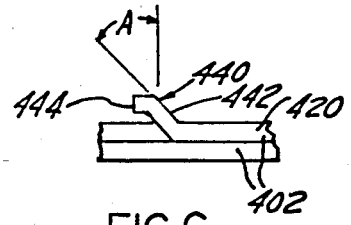
FIG. 6

ANTI-DECOUPLING MECHANISM FOR AN ELECTRICAL CONNECTOR ASSEMBLY

This application is a division, of application Ser. No. 493,535, filed May 11, 1983now U.S. Pat. No. 4,525,017.

This invention relates to an anti-decoupling mechanism for an electrical connector assembly.

Devices for resisting uncoupling rotation of a coupling nut due to vibration have utilized a spring-detent approach. Typical of this approach is U.S. Pat. No. 4,109,990, issuing Aug. 29, 1978 to Waldron et al and U.S. Pat. No. 4,268,103, issuing May 19, 1980 to Schildkraut et al, each patent being entitled "Electrical Connector Assembly Having Anti-Decoupling Mechanism" and each providing a straight spring beam of the type having its opposite ends mounted to the coupling nut and a medial tooth portion thereon tangent to and adapted to successively engage with ratchet teeth formed on one of the connector shells. To resist uncoupling rotation the ratchet teeth were formed with flanks having differing steepnesses. However, engagement of the medial tooth portion with the ratchet teeth is difficult to maintain and in some vibration environments the spring tooth will disengage from the ratchet teeth of perhaps one ratchet click and allow the connector members to undergo slight axial back-off. Should this occur, the connector members could undergo hammering increasing likelihood of connector degradation during severe vibration. Further, in applications where electro-magnetic interference must be prevented metal-to-metal contact between mated connector shells is essential and must not be disburbed. Accordingly, a major limitation of a spring beam device resisting uncoupling is a possible presence of back-off or loosening upon full mating and/or electro-magnetic interference.

Although axial hammering between the connector members can be partially eliminated by introduction of a wave washer, a spring beam increases the overall diameter of the connector assembly and a desirable connector would eliminate parts without elimination of their desirable functions. Accordingly, a desirable connector would eliminate back-off of a coupling nut and resist rotation of a coupling nut relative to mated connector shells by combining functions of parts.

This invention is characterized by a band of metal wound about itself a number of times to form a spiral having clamping surfaces which define an opening sized to interference fit circumferentially about an annular groove on one of the connector members, the spiral having side-by-side plates, opposite ends free with one free end including an arm adapted to successively engage detents disposed around the coupling nut, the band being radially expansible and contractible and adapted for movement between first and second positions depending, respectively, on rotation of the coupling member in either coupling and uncoupling directions, the detents being driven against the arm in rotating to either of the positions with the first position causing the band to radially expand and slide relative to the connector member and the second position causing the band to radially contract and the arm to laterally deflect from the detent, radial contraction increasing friction forces preventing relative rotation between the band and coupling member until sufficient torque is developed to laterally deflect the arm from the detent, thereby allowing the coupling member to rotate and detents to advance.

One advantage of the present invention is that a spiral band acts as a positive clutch for allowing rotation in the coupling direction but acting to increase resistance to uncoupling rotation. Further, interleaving and overlapping construction of the spiral band enhances resistance to relative axial movement of the coupling member relative to its mounting to resist hammering between the connector members. Further, the spiral spring limits axial motion of the coupling member and, by its being dome shaped, biases the coupling member forwardly and serves to eliminate a wave washer.

One way of carrying out the invention is described in detail below with reference to the drawings which illustrate one specific embodiment of this invention, in which:

FIG. 1 is a cross-section view of an electrical connector assembly having an anti-decoupling device.

FIG. 3 is an end view taken along lines III—III of FIG. 1 showing a circular band according to this invention.

FIG. 4 is a side view of the circular band.

FIG. 5 is an enlarged view of a portion of the band shown in FIG. 4.

FIG. 6 is an alternate embodiment of the circular band.

Figure 2:
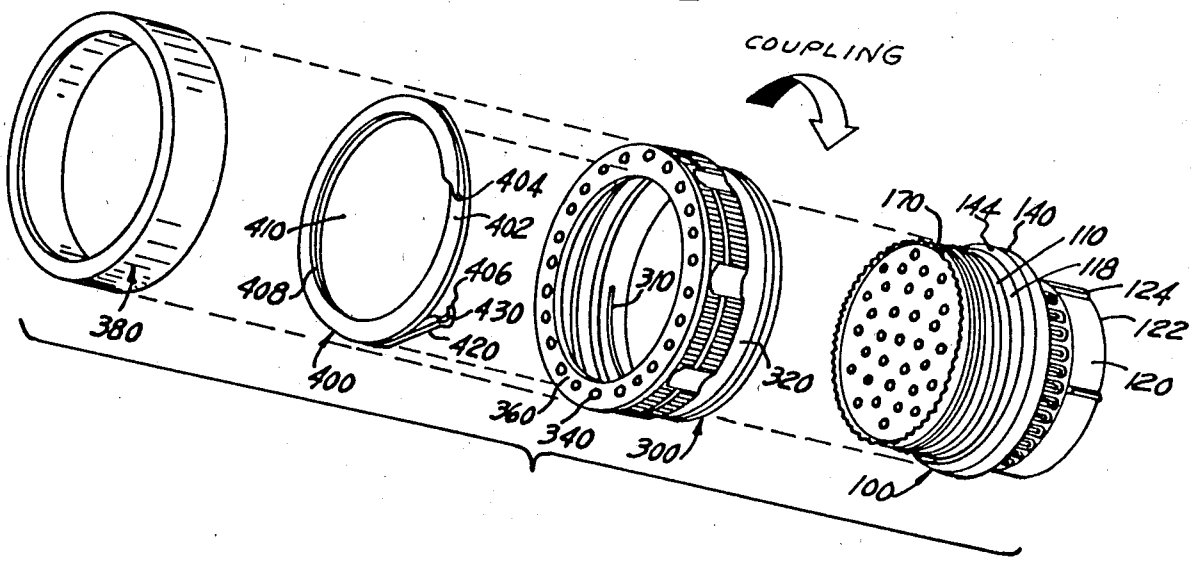
FIG. 2 is an exploded view of an electrical connector plug shell having an anti-decoupling device according to the present invention.

Referring now to the drawings, FIG. 1 shows an electrical connector assembly comprising a first shell 100, a second shell 200 (shown in phantom) mating with the first shell and a coupling nut 300 rotatably mounted to the first shell connecting the first and second shells together.

The first shell is generally cylindrical and comprises a forward portion 120 having a forward face 122, a rear portion 170 and an annular flange 140 disposed medially of the shell portions, rear portion 170 including an annular groove 110 having a forwardly facing rear end wall 112, a rearwardly facing front end wall 114 and an annular wall 116 therebetween and an annular surface 118 circumjacent annular flange 140, the annular flange including a front face 142 and a rear face 144. Typically the first shell 100 is characterized as a plug-type electrical connector member and, although not shown, would include one or more female-type (i.e. socket) electrical contacts retained therewithin by dielectric inserts. The outer surface of forward portion 120 includes one or more axial keys 124 for orienting the first shell 100 relative to the second shell 200 and for nonrotatably drawing the connectors axially together upon mating.

The second shell 200 is generally cylindrical and comprises a forward portion 220 having a forward face 222 and thread 210 externally formed on an outside surface thereof. Typically, the second shell 200 would be characterized as a receptacle electrical connector and, although not shown, includes one or more axially extending recesses or keyways for receiving the respective keys on the first shell 100 and one or more male-type (i.e. pin) electrical contacts that mate with the socket-type contacts of the first shell when the plug is drawn into the receptacle, the pin contacts being retained therewithin by dielectric inserts mounted in the second shell 200. Of course, the pin and socket contacts could be otherwise.

The coupling nut 300 is rotatably mounted over rear portion 170 of first shell 100 and comprises a generally cylindrical coupling sleeve 320 having a radial flange 322 and internal thread 310, the radial flange extending radially inward at one end of the coupling sleeve to circumpose annular surface 118 and be captivated for rotation against annular flange 140, the radial flange having an inner end wall 324 abutting rear face 144 of annular flange 140 and an outer end wall 326, the internal thread 310 being formed on the inner wall of and at the other end of coupling sleeve 320 and adapted to engage with external thread 210 on second shell 200 to bring the first and second shells together into mating engagement upon relative rotation therebetween, forward portion 220 of receptacle shell 200 being coaxially drawn between forward portion 120 of plug shell 100 and coupling sleeve 320 such that forward face 222 of the receptacle shell is abutting front face 142 of the annular flange 140 and inner end wa11 324 of radial flange 322 is abutting rear face 144 of the annular flange.

Preferably and in accord with this invention, a plurality of engageable detents 340 are disposed on coupling nut 300 and a spiral band 400 is interference fit within annular groove 110 and abutting against forwardly facing rear end wall 112 thereof, the spiral band captivating radial flange 322 for rotation against annular flange 140, resisting axial movement between connector shells 100, 200 and resisting uncoupling rotation of coupling nut 300. The spiral band includes interleaved overlapping construction and an arm 420 adapted to engage successive of detents 340 disposed around coupling nut 300, the arm 420 being adapted to drivingly rotate the spiral band upon rotation of coupling nut in a coupling direction and to be laterally deflected upon rotation of coupling nut 300 in an uncoupling direction.

Spiral band 400 comprises a flat leaf 402 formed from a resilient metal into a spiral having a number of overlapping leaf surfaces, opposite first and second ends 404, 406 with first end 404 abutting rear end wall 112 and second end 406 defining the distal portion of arm 420 and a clamping surface 408 defining a central opening 410 (see FIG. 2) having a diameter which is sized to interference fit circumferentially about annular wall 116 of annular groove 110, the spiral band being radially expansible and radially contractible and adapted for movement between first and second positions depending, respectively, on rotation of the coupling nut in either of coupling and/or uncoupling directions, such rotation driving successive detents 340 against the arm 420 and causing the spiral band to assume one or the other of the positions with the first position causing the spiral band to radially expand and slide relative to the annular wall and the second position causing the spiral band to want to radially contract and arm 420 to deflect laterally rearward and from engagement with detent 340, radial contraction increasing rotation resisting friction forces acting between annular wall 116 and clamping surfaces 408 sufficient to prevent rotation of the coupling nut until arm 420 is cammed by and laterally deflected from engagement with detent 340, thereby allowing the coupling nut 300 to rotate relative to first shell 100 and detents 340 to advance into engagement.

Although shown best in FIGS. 3–6, the arm 420 extends from leaf 402 as a cantilever to distal second end 406, the second end being free to deflect and having a terminal portion or dog 430 adapted to engage respectively of the detents 340.

To eliminate wear between spiral band 400 and radial flange 322 of coupling nut 300, an annular disk 360 including the plurality of detents 340 is non-rotatably secured to outer end wall 326 of the radial flange.

To protect spiral band 400, a housing 380 is disposed thereabout and secured to the coupling nut.

FIG. 2 shows disassembled relation between housing 380, spiral band 400, coupling nut 300 and plug shell 100, annular disk 360 being shown secured to the coupling nut. Assuming the plug shell is non-rotatably fixed, the arrow shows the direction of external torque for coupling rotation of the coupling nut relative to the plug shell.

The housing 380 is adapted to fit about the end portion of the coupling nut 300 to protect the spiral band 400 and its engagement with the detents 340.

The locus of detents 340 are uniformly disposed in a circle substantially equiangularly around annular disk 360.

As shown, each detent 340 is substantially circular in shape. However, a non-circular shape is equally within the contemplation of this invention.

Spiral band 400 comprises a generally circular annulus including interleaved overlapping construction having its opposite ends 404, 406 free, first end 404 thereof being adapted to abut forwardly facing rear end wall 112 of annular groove 110 and second end 406 forming the cantilever arm 420 extending tangentially therefrom, the cantilever arm including the dog 430 at its distal end which is adapted to successively engage each of the detents 340.

FIG. 3 shows the spiral band 400 mounted in annular groove 110 with clamping surfaces 408 being interference fit about annular wall 116, the cantilever arm 420 extending to its distal end 408 and the dog 430 engaging with a detent 340 on the coupling nut. Preferably and in accord with this invention and represented by "A" the cantilever arm 420 subtends an arc of approximately 45°. The leaf is substantially flat and rectangular in cross-section with the flat surfaces thereof overlapping and the long dimension of the rectangular cross-section being disposed in the radial direction relative to the assembly primary axis.

FIG. 4 shows a side view of spiral band 400 and the interleaved overlapping construction defining a pair of side-by-side annuli. Preferably and in accord with this invention, to axially bias connector shells 100, 200 spiral band 400 would be formed so as to assume a concave dome shape. As shown, dog 430 extends upwardly from the surface of one of the leafs.

FIG. 5 is an enlarged view of dog 430. As shown, the dog is generally V-shaped in cross-section and includes first and second flanks 432, 434 with first flank 432 being more steeply inclined than second flank 434, first flank 432 being adapted to non-releasably engage with the detent 340 to radially expand the spiral band 400 upon rotation of the coupling nut 300 in the coupling direction and second flank 434 being adapted to release from engagement with the detent by being cammed against detent 340 and driven laterally outward therefrom upon rotation of the coupling nut in the uncoupling direction.

FIG. 6 shows an alternate terminal portion embodiment for engaging with the detents 340 and comprises a dog 440 having a ramp face 442 angling upwardly from the plane of spiral band 402 and an abutment face 444 formed substantially perpendicular to the plane of spiral band 400, the ramp face 442 allowing the dog 440 to be cammed against the detent and deflected radially outward and axially rearward the plane of the band for uncoupling direction rotation and the abutment face 444 being adapted to transmit detent torques to the spiral band to expand the band radially outwardly for sliding rotation around the plug shell.

For assembly: coupling nut 300 is slid over rear portion 170 of the plug shell 100 so that the radial flange 322 is abutting annular flange 140, spiral band 400 is radially expanded and slid over rear portion 170 of plug shell 100 and registered with annular groove 110, whereupon the spiral band radially contracts and seats in an interferance fit therewithin, the cantilever arm 420 engaging one of the detents 340; and cover 380 is assembled over the rear portion of coupling nut 300 and secured thereto to protect the spiral band therewithin from being snagged or damaged.

The spiral band 400 acts much like a clutch spring and serves two primary functions. A first function is for mounting and biasing the coupling nut relative to the plug shell. The second function is provision of locking means for resisting rotation of the coupling nut relative to the plug shell.

In operation, the clutch spring is so configured that it will allow single direction rotation of the spiral band relative to the coupling nut 300. During mating of the connector shells 100, 200 by rotation of the coupling nut 300, the detent 340 is driven against flank face 432 or abutment face 444 of the dog 430, 440, disengagement force being transmitted through the arm 420 and to the spiral band 400 thus tending to open (i.e. radially expand the spring), thereby eliminating the frictional interference fit therebetween to allow the spiral band 400 to rotate with the coupling nut relative to annular wall 116 of the plug shell. At any point where the external torque causing the coupling nut 300 to rotate is discontinued, the spiral band 400 will once again radially contract and provide locking action for resisting rotation. During unmating of the connector shells 100, 200 the detent 300 is driven against the dog 430 or 440, tending to drive the cantilever arm 420 radially inward toward annular wall 116. Further external torque on the arm 420 tends to close the spiral about the plug shell and to increase the frictional resistance between clamping surfaces 408 of the spiral band and annular wall 116 of plug shell 100. Ultimately, upon application of sufficient external torque, the dog 430 or 440 is cammed laterally relative to the plane of spiral band 400 and outwardly from engagement with the detent 340. Uncoupling rotation cannot be initiated until either dog 430 or 440 is driven upwardly from the detent 340 and the cantilever arm 420 deflected. This single direction rotation will provide a "clicking" action when the coupling nut 300 is being unmated, since the clutch spring grips the plug shell and cannot move relative to it. The gripping action resulting from the arm being driven radially inward and a tightening the frictional grip around the annular wall provides the essential nonrotatability of the coupling nut.

Preferably and in accord with this invention the coupling nut could be comprised of a thermoplastic material. In such event, a stainless steel raceway could be affixed to the annular face of the coupling nut to reduce the wear.

Further, it is contemplated that the detents could be disposed equiangularly about the inner wall of the coupling sleeve, a retaining ring positioning the radial flange of the coupling nut adjacent the annular flange of the plug shell, and an annular band being disposed like a watch coil about an annular surface of the plug shell circumposed by the detents, the annular band in this case being rectangular in cross section with the long dimension of the rectangle being axially disposed.

We claim:

1. A clutch spring for resisting two direction relative rotation between a connector shell and a coupling nut, said coupling nut being rotatably mounted to the shell and having a plurality of engagable detents, said clutch spring comprising a flat leaf of generally rectangular cross-section having opposite ends and formed into a helical coil the inner diameter of which is sized to circumpose and normally immovably frictionally engage about said shell with one and the other said end thereof, respectively, being free and including a lock arm cantilevered therefrom adapted to engage successive of said detents whereby to resist both coupling and uncoupling rotation, said leaf having the long dimension of its cross-section extending radially and the leaf when coiled defining a frusto-conical spring which is adapted to axially bias said coupling nut, said lock arm extending generally tangentially from the coil to terminate in a terminal portion adapted to fit respective of said detents to resist both coupling and uncoupling rotation, coupling rotation requiring the terminal portion to radially expand the coil and uncoupling rotation requiring first that the terminal portion be forced against its detent whereby to drive the lock arm radially inward to place a winding torque on the coil and second that the terminal portion cam the lock arm axially rearwardly and outwardly from engagement with its detent so that the lock arm may advance into engagement with another detent.

2. A helical coil spring for use in resisting relative rotation between each of two relatively rotatable connector members, one and the other of said connector members including, respectively, an annular recess for receiving the spring and a plurality of detents each of which being disposed in a plane generally perpendicular to the axis of rotation, characterized by said coil spring being adapted to normally frictionally engage said recess and having a pair of end portions with one said end portion cantilevering from the coil and having its terminal portion operatively connectable and disconnectable with successive of the detents in the other member whereby to transmit winding and unwinding torques to the coil depending upon the direction of rotation, unwinding torques tending to cause the coil to unwind and thereby disengage from its frictional engagement with the recess to rotate and allow rotation, and winding torques tending to cause the coil to wind whereby to increase frictional engagement with the recess until a sufficient torque causes the one said end portion to radially and axially snap from engagement with its detent whereby to allow limited relative rotation only between the two members.

* * * * *